US005494293A

United States Patent [19]

Goldfarb

[11] Patent Number: 5,494,293

[45] Date of Patent: Feb. 27, 1996

[54] METHOD OF PLAYING A GAME OF CHANCE USING PRE-DRAWN NUMBERS

[76] Inventor: Simon Goldfarb, 525 S. Ardmore, Los Angeles, Calif. 90020

[21] Appl. No.: 333,043

[22] Filed: Nov. 1, 1994

[51] Int. Cl.[6] ..... A63F 3/06

[52] U.S. Cl. ..... 273/269; 273/139

[58] Field of Search ..... 273/269, 139, 273/148 R, 138 R

[56] References Cited

U.S. PATENT DOCUMENTS 2,484,143 10/1949 Arnold ..... 273/269
4,019,744 4/1977 Pizur, Sr. ..... 273/269

FOREIGN PATENT DOCUMENTS 3820851 12/1989 Germany ..... 273/148 R

*Primary Examiner*—Benjamin H. Layno
*Attorney, Agent, or Firm*—Erik M. Arnhem

[57] ABSTRACT

The game of BINGO is played with Bingo cards having one free space and twenty four fill-in spaces. The BINGO players can mark each fill-in space to designate a selected number for that particular space. Each player has a wide selection of numbers that can be used in playing the BINGO card. The winning numbers are read from a sheet of paper that is prepared and stored in a closed receptacle prior to start of the game. Game apparatus is relatively low cost, while being versatile.

6 Claims, 2 Drawing Sheets

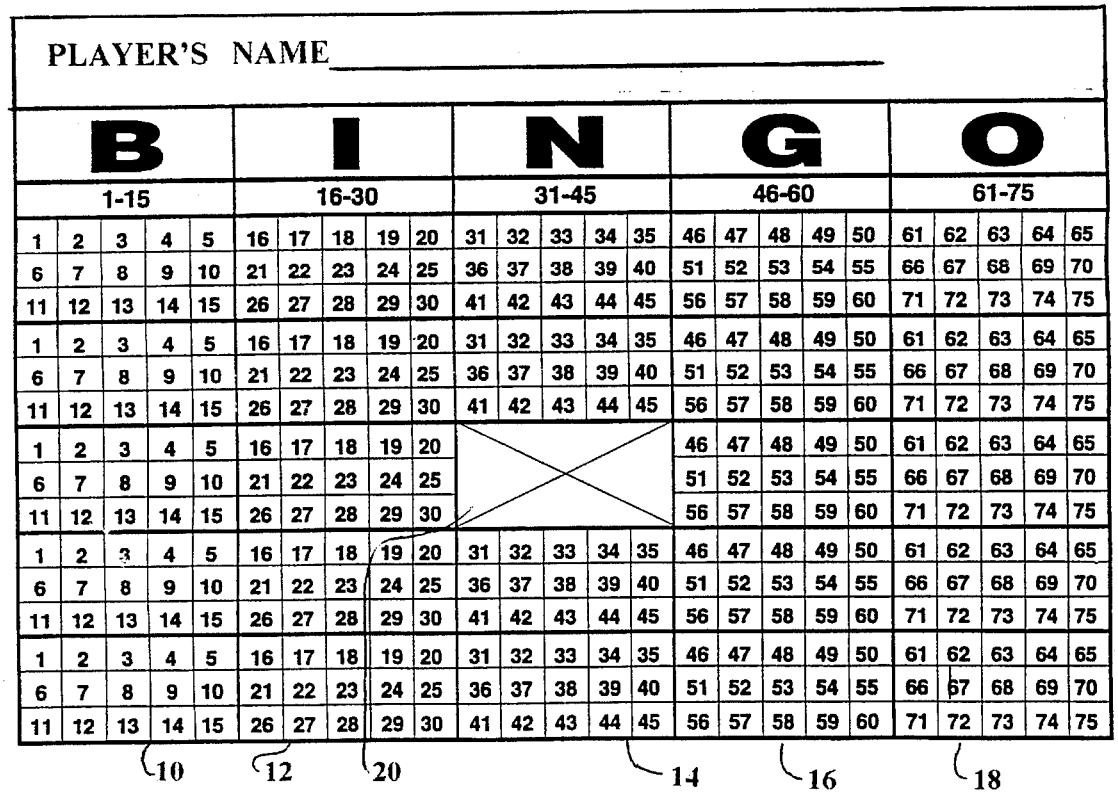

PLAYER'S NAME _____

| B | | | | | I | | | | | N | | | | | G | | | | | O | | | | |
|---|---|---|---|---|---|---|---|---|---|---|---|---|---|---|---|---|---|---|---|---|---|---|---|---|
| 1-15 | | | | | 16-30 | | | | | 31-45 | | | | | 46-60 | | | | | 61-75 | | | | |
| 1 | 2 | 3 | 4 | 5 | 16 | 17 | 18 | 19 | 20 | 31 | 32 | 33 | 34 | 35 | 46 | 47 | 48 | 49 | 50 | 61 | 62 | 63 | 64 | 65 |
| 6 | 7 | 8 | 9 | 10 | 21 | 22 | 23 | 24 | 25 | 36 | 37 | 38 | 39 | 40 | 51 | 52 | 53 | 54 | 55 | 66 | 67 | 68 | 69 | 70 |
| 11 | 12 | 13 | 14 | 15 | 26 | 27 | 28 | 29 | 30 | 41 | 42 | 43 | 44 | 45 | 56 | 57 | 58 | 59 | 60 | 71 | 72 | 73 | 74 | 75 |
| 1 | 2 | 3 | 4 | 5 | 16 | 17 | 18 | 19 | 20 | 31 | 32 | 33 | 34 | 35 | 46 | 47 | 48 | 49 | 50 | 61 | 62 | 63 | 64 | 65 |
| 6 | 7 | 8 | 9 | 10 | 21 | 22 | 23 | 24 | 25 | 36 | 37 | 38 | 39 | 40 | 51 | 52 | 53 | 54 | 55 | 66 | 67 | 68 | 69 | 70 |
| 11 | 12 | 13 | 14 | 15 | 26 | 27 | 28 | 29 | 30 | 41 | 42 | 43 | 44 | 45 | 56 | 57 | 58 | 59 | 60 | 71 | 72 | 73 | 74 | 75 |
| 1 | 2 | 3 | 4 | 5 | 16 | 17 | 18 | 19 | 20 | | | | | | 46 | 47 | 48 | 49 | 50 | 61 | 62 | 63 | 64 | 65 |
| 6 | 7 | 8 | 9 | 10 | 21 | 22 | 23 | 24 | 25 | | | | | | 51 | 52 | 53 | 54 | 55 | 66 | 67 | 68 | 69 | 70 |
| 11 | 12 | 13 | 14 | 15 | 26 | 27 | 28 | 29 | 30 | | | | | | 56 | 57 | 58 | 59 | 60 | 71 | 72 | 73 | 74 | 75 |
| 1 | 2 | 3 | 4 | 5 | 16 | 17 | 18 | 19 | 20 | 31 | 32 | 33 | 34 | 35 | 46 | 47 | 48 | 49 | 50 | 61 | 62 | 63 | 64 | 65 |
| 6 | 7 | 8 | 9 | 10 | 21 | 22 | 23 | 24 | 25 | 36 | 37 | 38 | 39 | 40 | 51 | 52 | 53 | 54 | 55 | 66 | 67 | 68 | 69 | 70 |
| 11 | 12 | 13 | 14 | 15 | 26 | 27 | 28 | 29 | 30 | 41 | 42 | 43 | 44 | 45 | 56 | 57 | 58 | 59 | 60 | 71 | 72 | 73 | 74 | 75 |
| 1 | 2 | 3 | 4 | 5 | 16 | 17 | 18 | 19 | 20 | 31 | 32 | 33 | 34 | 35 | 46 | 47 | 48 | 49 | 50 | 61 | 62 | 63 | 64 | 65 |
| 6 | 7 | 8 | 9 | 10 | 21 | 22 | 23 | 24 | 25 | 36 | 37 | 38 | 39 | 40 | 51 | 52 | 53 | 54 | 55 | 66 | 67 | 68 | 69 | 70 |
| 11 | 12 | 13 | 14 | 15 | 26 | 27 | 28 | 29 | 30 | 41 | 42 | 43 | 44 | 45 | 56 | 57 | 58 | 59 | 60 | 71 | 72 | 73 | 74 | 75 |

10 12 20 14 16 18

FIG. 1

FIG. 2

PLAYER'S NAME _____

| B | I | N | G | O |
|---|---|---|---|---|
| 1 - 15 | 16 - 30 | 31 - 45 | 45 - 60 | 61 - 75 |
| | | | | |
| | | | | |
| | | | | |
| | | | | |
| | | | | |

10 20 18 12 14 16

| | | |
|---|---|---|
| B | 3 | 7 - 9 - 13 - 14 - 15 |
| I | 18 | 21 - |
| N | 32 | 36 - 37 - 39 |
| G | 46 | 47 - 51 - 52 - 59 - 60 |
| O | 63 | 65 - 67 - 68 -72 |

22

FIG. 3

METHOD OF PLAYING A GAME OF CHANCE USING PRE-DRAWN NUMBERS

BACKGROUND OF THE INVENTION

1. Field of the Invention

This invention relates to a method of playing a game of chance, primarily BINGO; however, the system according to the invention is adaptable to a variety of "number" or "sign" games, such as Keno, Lottery, Roulette, etc.

2. Prior Developments

The game called BINGO involves the prediction or selection of a combination of numbers, according to the appearance of the numbers on a BINGO card. Each game player receives one or more BINGO cards, each containing e.g., twenty five spaces, arranged in five columns under the letters in the name BINGO printed on the card. The third space in the "N" column is a free space that can be used in any winning combinations; the other twenty four spaces have numbers printed thereon, designating the player's number selection for the respective spaces.

There are seventy-five different numbers used in the BINGO game. Numerals 1 through 15 can appear in the "B" column; numerals 16 through 30 can appear in the "I" column; numerals 31 through 45 can appear in the "N" column; numerals 46 through 60 can appear in the "G" column, and numerals 61 through 75 can appear in the "O" column. Any particular card will have twenty four of the seventy five numerals printed thereon. The number combinations will be different on different BINGO cards.

Each game player has the objective of holding a BINGO card having a winning combination of numbers; various different winning combinations are possible, e.g. five numbers in a row, either horizontally, vertically or diagonally; or all spaces on the card, or the four corner spaces.

The winning numbers are selected by drawing the numbers out of a box or container. In professionally conducted BINGO games the numbers are printed on individual ping-pong balls placed in a container having pressurized swirling air for rapidly circulating the balls within the container chamber. Air exhausted from the chamber propels a selected ball out of an exit opening in the container front wall, such that the game operator can read the number on the ball as a selected number.

Balls are drawn out of the container until the different selected numbers are matched by the numbers on one or more BINGO cards as winning combinations.

One problem with professionally conducted BINGO games is the relatively high cost of the air chambers used to contain the numbered ping-pong balls. Such chambers are not feasible for small BINGO games, i.e. games having only a few participants, such as in convalescent homes, family reunions, or party situations.

Another problem with conventional BINGO games is that the game players cannot select the numbers to be used on their individual BINGO cards. Each player is restricted to a particular combination of numbers printed on the selected BINGO card.

SUMMARY OF THE INVENTION

The present invention provides a method of playing BINGO that overcomes the above-noted disadvantages. In one preferred BINGO game devised in accordance with the invention, each BINGO card has twenty four fill-in spaces that the player can mark to designate his or her selected number for that space. The player thus has an unlimited choice of numbers from which to select; the player is not restricted to particular number combinations.

In preferred practice of the invention the winning numbers are printed or written on a sheet of paper prior to the start of the BINGO game; the sheet containing the winning numbers is placed in a receptacle that is closed or sealed until after the players have filled out the BINGO cards. When it is time to announce the winning numbers the storage receptacle for the sheet of winning numbers is opened, and the sheet removed so that the winning numbers can be read from the sheet.

This method of selecting and storing the winning numbers represents an attractive low cost alternative to the costly ping-pong ball selection method often employed in professionally conducted BINGO games.

The BINGO game of the present invention is intended for use by relatively small groups of people, who may not be in a position to utilize the conventional costly BINGO game systems.

THE DRAWINGS

FIG. 1 is a plan view of a BINGO card used in practice of the invention.

FIG. 2 is a plan view of another BINGO card that can be used in practice of the invention.

FIG. 3 is a plan view of a printed sheet of winning numbers usable with the game cards of FIG. 1 and 2.

DESCRIPTION OF A PREFERRED FORM OF THE INVENTION

FIGS. 1 and 2 illustrate two different BINGO cards that can be alternatively used by BINGO players, according to the present invention.

As shown in FIG. 1, the BINGO card is subdivided into twenty five spaces arranged in five vertical columns under the individual letters in the BINGO name. For reference purposes, the column of spaces under the letter "B" is designated by numeral 10 the column of spaces under the letter "I" is designated by numeral 12, the column of spaces under the letter "N" is designated by number 14, the column of spaces under the letter "G" is designated by numeral 16, and the column of spaces under the letter "O" is designated by numerical 18. Each vertical column 10, 12, 14, 16 or 18 contains five separate spaces. The spaces are separated from each other by double lines.

The third space in the "N" column is a free space usable with the other twenty four spaces to make winning number combinations on the BINGO card. The free space is designated numeral 20 in FIG. 1.

The other 24 spaces on the card are designed as "fill-in" spaces meaning that the game player can fill in the space to select a number for playing the game. Each space in the "B" column 10 is printed with numbers 1 through 15. The player can select any number for each space in the "B" column by circling or marking a particular one of the fifteen numbers in the respective space. The selected number can be circled or drawn through so as to leave a visual indication of the selected number.

Each fill-in space in the remaining columns 12, 14, 16 and 18 are printed with another set of numbers; e.g. numbers 16 through 30 for each space in the "I" column, numbers 31 through 45 for each fill-in space in the "N" column; numbers 45 through 60 for each space in the "G" column; and numbers 61 through 75 for each space in the "O" column.

The player selects a number for each of the twenty four fill-in spaces by marking the number of his or her choice in each space. The player thus has a relatively wide choice in the numbers he or she wishes to play.

FIG. 2 shows an alternative to the BINGO card of FIG. 1. In FIG. 2, each of the twenty four fill-in spaces is a blank space. The player selects a number for each fill-in space by writing the number of his or her choice in each respective space.

Each vertical column 10, 12, 14, 16 or 18 has a heading located below the respective BINGO letter designating the range of numbers that can be written in each respective space, e.g. numbers 1 through 15 for the "B" column, numbers 16 through 30 for the "I" column, and so on for the other columns.

FIG. 3 shows a sheet 22 used by the game director for selecting the winning combination of numbers. The sheet contains five columns of spaces respectively next to the letters.

In the illustrated sheet 22 there are five rows of spaces. Numbers may be printed on sheet 22 to indicate selected numbers; alternatively, the numbers may be written on the sheet by the game operator, prior to start of the game.

The FIG. 3 sheet is shown in a partially completed state, with numbers selected. As an example the first numbers selected are B-3-7-9-13-14-15; the second numbers selected are I-18-21 and so on. As indicated above, in practice the entire selection of forty numbers would be made prior to start of the game, either by printing operation of the game, or by the game operator filling in the numbers on a random basis. Sheet 22 can have space for more than forty numbers if so desired.

The winning number sheet 22 will be sealed in a closed receptacle until it is time to announce the winning numbers, i.e. after the players have received and completed their BINGO cards (per FIG. 1 or FIG. 2). The receptacle can take various forms, e.g. a sealed envelope or a closed box.

The game is played by announcing the winning numbers in order of their pre-drawn selection on sheet 22, (FIG. 3). The game director removes sheet 22 from the storage receptacles and announces the winning numbers in the order of their appearance on the sheet 22. In FIG. 3 example the first number drawn is B-3, the second number drawn is I-18, etc.

While the game director is announcing the numbers, in the order of their appearance on sheet 22, the game players are placing tokens or counters (disks) on the corresponding selected numbers on their respective BINGO cards. When a player has a winning combination he or she calls out the word, BINGO. The process is similar to conventional BINGO procedures except that the winning numbers are read from sheet 22 instead of being drawn out of a box.

It is desirable that the players have a complete listing of the winning numbers while the game director is reading the numbers from sheet 22, especially if there are a relatively great number of players. The players can then refer to the complete listing if in doubt as to whether a particular number has been announced.

A complete listing of the winning numbers may be provided by projecting an image of sheet 22 onto a screen, via a conventional still projector. Sheet 22 can be placed on the transparent plate of a projector while the game director is announcing the winning numbers. The players can thus refer to the screen if in doubt as to any particular number.

The process announcing the winning numbers, and determining a winner is relatively quick.

As an option, each BINGO card can be prepared in duplicate; the original can be retained by the player, and the copy can be given to the game director for verification purposes in situations where there is a dispute as to whether a particular number was selected on the player's card. The duplicate copy can be a carbon copy detachable from the BINGO after completion by the player.

It should also be noted that the system, according to the invention is adaptable to such games played in foreign countries not using the word, BINGO and having "90 numbers" instead of the conventional "75 number game" played in the U.S.A.

What is claimed is:

1. A method of playing the game of BINGO comprising:

A. the game director placing a sheet containing the winning combination in a receptacle, and closing the receptacle so that the players are unaware of the winning combination;

B. the game director providing each player with a BINGO card, wherein each BINGO card is marked to include twenty five spaces arranged in five vertical columns under the letters in the BINGO name; the third space in the N column being a free space, and each of the other twenty four spaces being a fill-in space that the player can mark to designate his or her selected number for that space;

C. each player marking each fill-in space to designate a selected number for the respective space;

D. the game director opening said receptacle and removing the sheet containing the winning combinations; and E. the game director announcing each winning number sequentially according to the order of appearance on the sheet, while the players place tokens on the corresponding number selections on their respective BINGO cards, until a winner is determined.

2. The method of claim 1, wherein each fill-in space is a blank space; step (C) comprising each player writing a a number in each fill-in space.

3. The method of claim 1, wherein each fill-in space contains a plurality of different numbers printed thereon; step (C) comprising each player marking one of the numbers in each fill-in space to indicate the selected numbers for that space.

4. The method of claim 1, wherein each BINGO card has a copy associated therewith; step (C) being carried out so that when the fill-in spaces are marked the selected numbers appear on the copy;

the method further comprising:

each player providing the director with a marked copy of his or her BINGO card after step (C) and prior to step (D).

5. The method of claim 1, and further comprising:

the game director pictorially displaying the winning number sheet to the players during step (E) so that the players have a complete listing of the winning numbers.

6. The method of claim 1, wherein the receptacle is an envelope.

* * * * *